US010975884B2

(12) United States Patent
Gauss et al.

(10) Patent No.: US 10,975,884 B2
(45) Date of Patent: Apr. 13, 2021

(54) INLET NOZZLE FOR A RADIAL, DIAGONAL OR AXIAL-FLOW FAN, AND A RADIAL, DIAGONAL OR AXIAL-FLOW FAN COMPRISING AN INLET NOZZLE

(71) Applicant: Ziehl-Abegg SE, Künzelsau (DE)

(72) Inventors: Tobias Gauss, Niedernhall (DE); Daniel Seifried, Schwäbisch Hall (DE); Achim Kaercher, Forchtenberg (DE); Andreas Herbert, Mulfingen (DE)

(73) Assignee: Ziehl-Abegg SE, Kunzelsau (DE)

( * ) Notice: Subject to any disclaimer, the term of this patent is extended or adjusted under 35 U.S.C. 154(b) by 0 days.

(21) Appl. No.: 15/570,353

(22) PCT Filed: Apr. 25, 2016

(86) PCT No.: PCT/DE2016/200194
§ 371 (c)(1),
(2) Date: Oct. 29, 2017

(87) PCT Pub. No.: WO2016/173595
PCT Pub. Date: Nov. 3, 2016

(65) Prior Publication Data

US 2018/0142702 A1 May 24, 2018

(30) Foreign Application Priority Data

Apr. 29, 2015 (DE) ..... 102015207948.1

(51) Int. Cl.
*F04D 29/54* (2006.01)
*F04D 19/00* (2006.01)
(Continued)

(52) U.S. Cl.
CPC ..... *F04D 29/541* (2013.01); *F04D 17/16* (2013.01); *F04D 19/002* (2013.01);
(Continued)

(58) Field of Classification Search
CPC .... F04D 17/16; F04D 19/002; F04D 29/4213; F04D 29/547; F04D 29/681;
(Continued)

(56) References Cited

U.S. PATENT DOCUMENTS

2008/0085186 A1* 4/2008 Kurszewski ..... F04D 29/162 415/206
2017/0159674 A1* 6/2017 Maciolek ..... B64C 7/02
(Continued)

FOREIGN PATENT DOCUMENTS

DE 102012021372 A1 * 4/2014

*Primary Examiner* — Sizo B Vilakazi
(74) *Attorney, Agent, or Firm* — McDonnell Boehnen Hulbert & Berghoff LLP

(57) ABSTRACT

An inlet nozzle (1) for a radial, diagonal or axial-flow fan, comprising an inlet section (3) that is circular in cross-section, has a radius of curvature, and tapers in diameter in the direction of flow (4), characterized by the presence of a measure or a flow element on or in the curved surface (5) of the inlet section for the purpose of forcing turbulent boundary layers in the flow, which can counteract a stall in this region. A radial, diagonal or axial-flow fan comprises a corresponding inlet nozzle (1).

9 Claims, 6 Drawing Sheets

Figure 1:
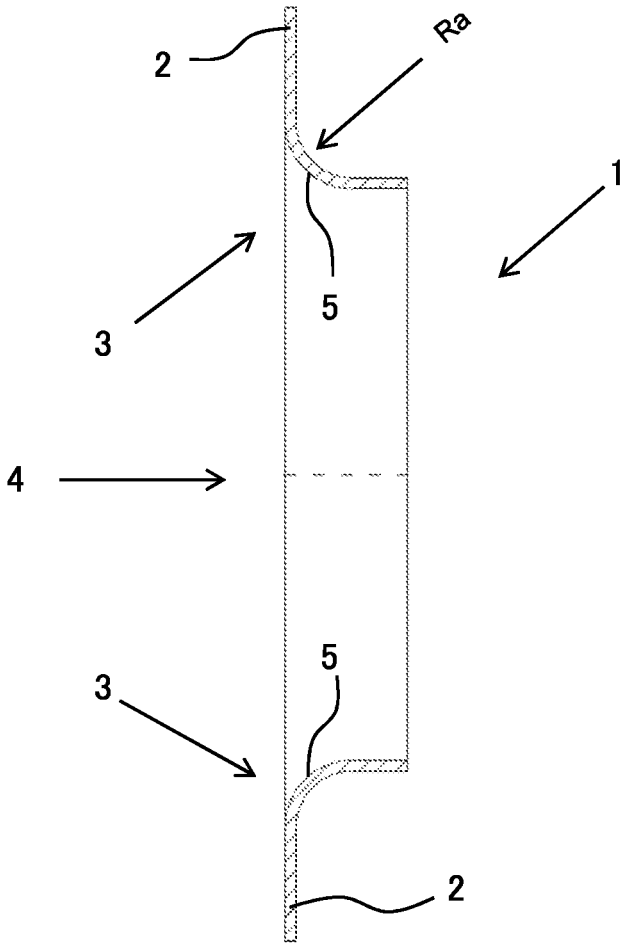

(51) Int. Cl.

| | |
|---|---|
| ***F04D 29/42*** | (2006.01) |
| ***F04D 17/16*** | (2006.01) |
| ***F04D 29/68*** | (2006.01) |
| ***F04D 29/32*** | (2006.01) |
| ***F04D 29/66*** | (2006.01) |

(52) U.S. Cl.
CPC ..... *F04D 29/325* (2013.01); *F04D 29/4213* (2013.01); *F04D 29/547* (2013.01); *F04D 29/665* (2013.01); *F04D 29/681* (2013.01); *F05D 2250/51* (2013.01)

(58) Field of Classification Search
CPC .... F04D 29/325; F04D 29/541; F04D 29/665; F05D 2250/51
See application file for complete search history.

(56) References Cited

U.S. PATENT DOCUMENTS

2018/0313362 A1* 11/2018 Hadlock ..... F04D 29/526
2018/0313363 A1* 11/2018 Hadlock ..... F04D 29/541

* cited by examiner

INLET NOZZLE FOR A RADIAL, DIAGONAL OR AXIAL-FLOW FAN, AND A RADIAL, DIAGONAL OR AXIAL-FLOW FAN COMPRISING AN INLET NOZZLE

This application is a U.S. National Phase Application pursuant to 35 U.S.C. § 371 of International Application No. PCT/DE2016/200194 filed Apr. 25, 2016, which claims priority to German Application Serial No. 10 2015 207 948.1, filed Apr. 29, 2015. The entire disclosure contents of these applications are herewith incorporated by reference into the present application.

The invention relates to an inlet nozzle for a radial, diagonal or axial-flow fan, comprising an inlet section that is circular in cross-section, has a radius of curvature and tapers in diameter in the direction of flow. The invention further relates to a radial, diagonal or axial-flow fan with a corresponding inlet nozzle.

Axial-flow fans and radial fans are well known from practice. Merely by way of example reference is made to DE 200 01 746 U1, U.S. Pat. No. 6,499,948 B1 and DE 10 2012 021 372 A1.

Such fans are routinely equipped with an inlet nozzle or suction nozzle, via which the fan draws in air that flows via an inlet opening first to the inlet region of the inlet nozzle and from there to the outlet region of the inlet nozzle.

In the case of an axial-flow fan, which draws in air from the outside, the inflowing air is conducted via such an inlet nozzle. This inlet nozzle can be designed with a flow-optimized inlet radius. The inlet nozzle is supposed to supply the air flow to the rotating axial impeller preferably without turbulence and losses. Since there are no exact approaches for determining the geometry of an optimal inlet nozzle, the inlet radius is regularly determined by experimentation, i.e. empirically, usually on the basis of structural parameters of the fan.

It is known that in the case of insufficiently large radii there can be stalls in the inlet region or in the region of the inlet radius. These stalls interact with the rotating impeller, wherein such interactions lead to increased sound levels and loss of power.

Due to installation conditions in the respective application of the fan a small inlet radius can be required. Moreover, frequently flange dimensions for the nozzles are provided by the customer that must be observed in the dimensioning of the fan or of the inlet nozzle.

A reduction of the nozzle height and/or of the flange dimensions without further loss of power would offer enormous advantages, namely within the scope of a reduction of installation space or height of the fan.

It is of fundamental importance that, in the case of a smaller inlet radius, the total size of the inlet nozzle, in particular the nozzle height and/or the flange dimensions, can be reduced, which in turn leads to material savings.

From the previously mentioned DE 10 2012 021 372 A1 measures are known in the outlet region of the inlet nozzle, according to which the wall of the outlet region consists of consecutive wall sections, each joining one another via an edge running over the periphery of the wall sections. However, in practice it turns out that these measures are only suitable to a limited extent for eliminating the disruptive stalls, which lead to increased sound levels and loss of power.

Therefore, the present invention addresses the problem of specifying an inlet nozzle for a radial, diagonal or axial-flow fan and a radial, diagonal or axial-flow fan with a corresponding inlet nozzle that is suitable for preventing, or at least reducing the disadvantages occurring in the prior art, caused by unwanted stalls, namely for the reduction of sound levels and loss of power.

The foregoing problem is solved with respect to the inlet nozzle by the features of claim 1. Accordingly, the generic inlet nozzle is characterized by the presence of a measure or a flow element on or in the curved surface of the inlet section, in particular for the purpose of forcing turbulent boundary layers in the flow, which can counteract a stall in this region.

A radial, diagonal or axial-flow fan equipped with such an inlet nozzle is characterized by the features of the equivalent claim 8, with the same features as the inventive inlet nozzle. The inventive inlet nozzle solves a problem which occurs predominantly in the case of inlet nozzles with small radii in the inlet section, also in the case of an optimized inlet radius. In particular in the case of small radii, in the prior art it cannot be avoided that stalls occur in the inlet radius, which lead to turbulence in the flow. This turbulence is supplied to the rotating fan propeller and leads to considerable losses.

At this point it should be noted that the inventive inlet nozzle has a radius of curvature, so that here we are discussing an inlet nozzle "with a radius". The term "radius of curvature" should be understood in the broadest sense. The "radius" can be composed of several partial radii, in each case with a continuous or discontinuous transition between the partial radii.

In the case of a sufficiently large radius, this can be optimized with respect to noise generation and performance. In the case of decreasing radii, this is problematic, so that the inventive measure is effective in particular in the case of small radii. The effects of geometric measures that can be determined by sound power measurements on different geometries indicate that it is also possible to prevent stalls on small radii, namely when in the inlet region, i.e. in the radius of curvature (or in the respective partial radius) for example turbulent boundary layers are forced that can counteract a stall.

In particularly advantageous manner the curved inlet section has an annular recess in terms of a zonal expansion of this region, namely an annular region in the inner surface of the inlet section, which acts as a flow element that counteracts, or at least delays a stall.

In place of a single recess, two or more recesses spaced at a distance from one another can also be provided, as required, resulting from the radius to be achieved in accordance with the desired size.

The recess or the expansion can be implemented as a recoiling edge, wherein the consideration is based on the fact that a recoiling edge initially separates the flow, wherein the main flow then attaches to the offset geometry. This is achieved by a vortex which positively suctions the main flow in the region of the separation (Source: Nitsche, W.: Strömungsmesstechnik [Flow Measurement Technology], Springer-Verlag 1994 (geometrisch induzierte Ablösung) [geometrically induced separation).

The expansion in the radius of the inlet section can be designed as an outward recoiling edge. Correspondingly, the edge is formed by two angulations or bend angles, namely by bend angles $\alpha$ and $\beta$ with the rule $180° < \alpha < 270°$ and $180° > \beta > 90°$. Exceptionally favorable flow conditions arise in this range.

In the case of the provision of a single recess it is advantageous if it is configured approximately centrally or in the inner third of the inlet section, namely in order to optimally promote the flow with respect to the forcing of turbulent boundary layers and hence to prevent stalls.

The inlet nozzle can be entirely made of plastic. Within the scope of a simple configuration it is appropriate to make the inlet nozzle out of metal, in particular sheet metal, taking conventional production methods for manufacturing sheet metal parts as a basis. In so doing, the expansion or annular recess can be greater than the thickness of the sheet metal, to ensure sufficient stability. Furthermore, it is advantageous if the length of the recess is greater than the depth of the recess, namely in order to promote the flow conditions to the extent that the separation area defined right after the recess for the flow is in a suitable proportion to the length of the recess and the reattachment point of the flow. For example, the recess can be generated by deep-drawing or stamping the sheet metal.

Figure 4:
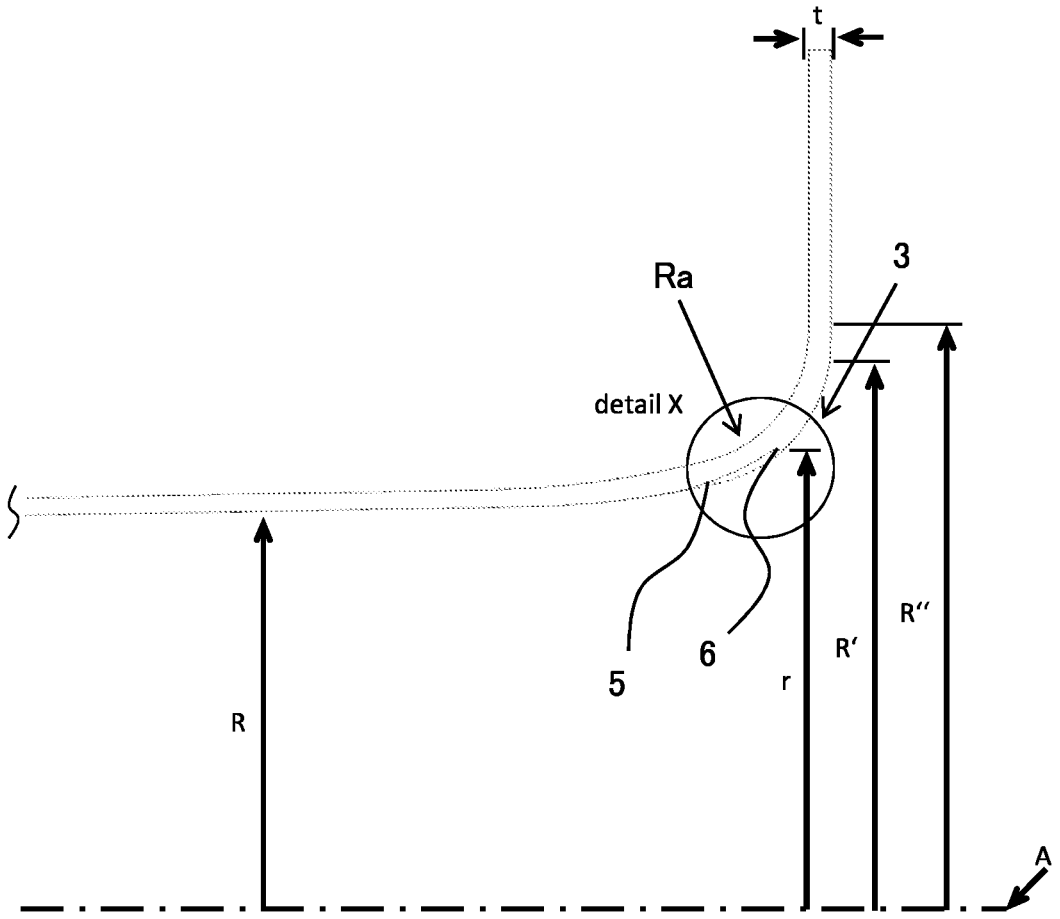
Figure 5:
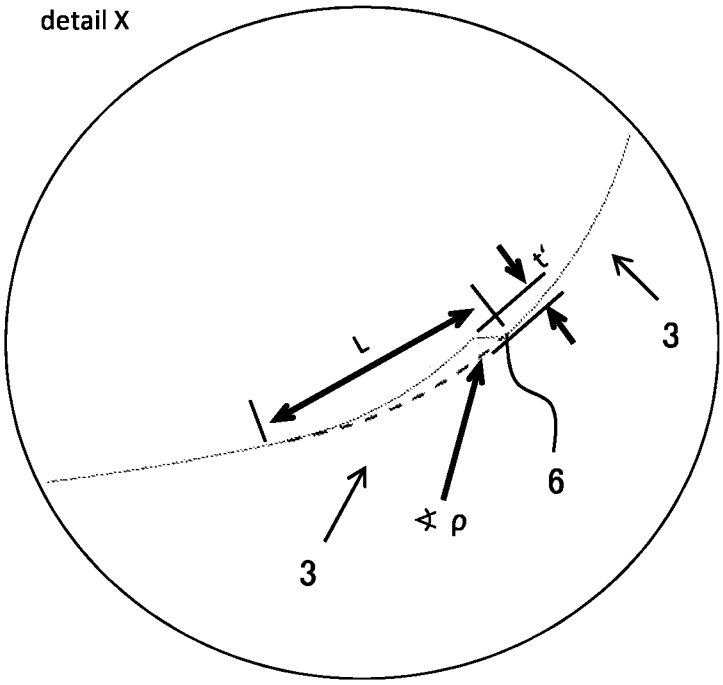
Figure 5:
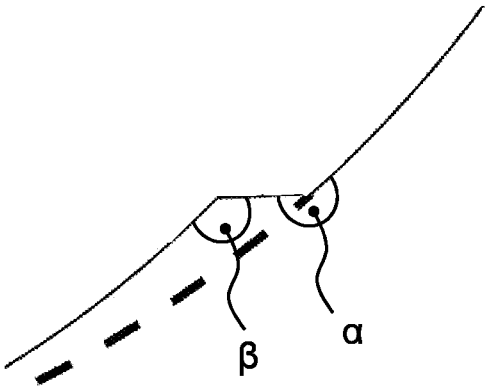
Figure 6:
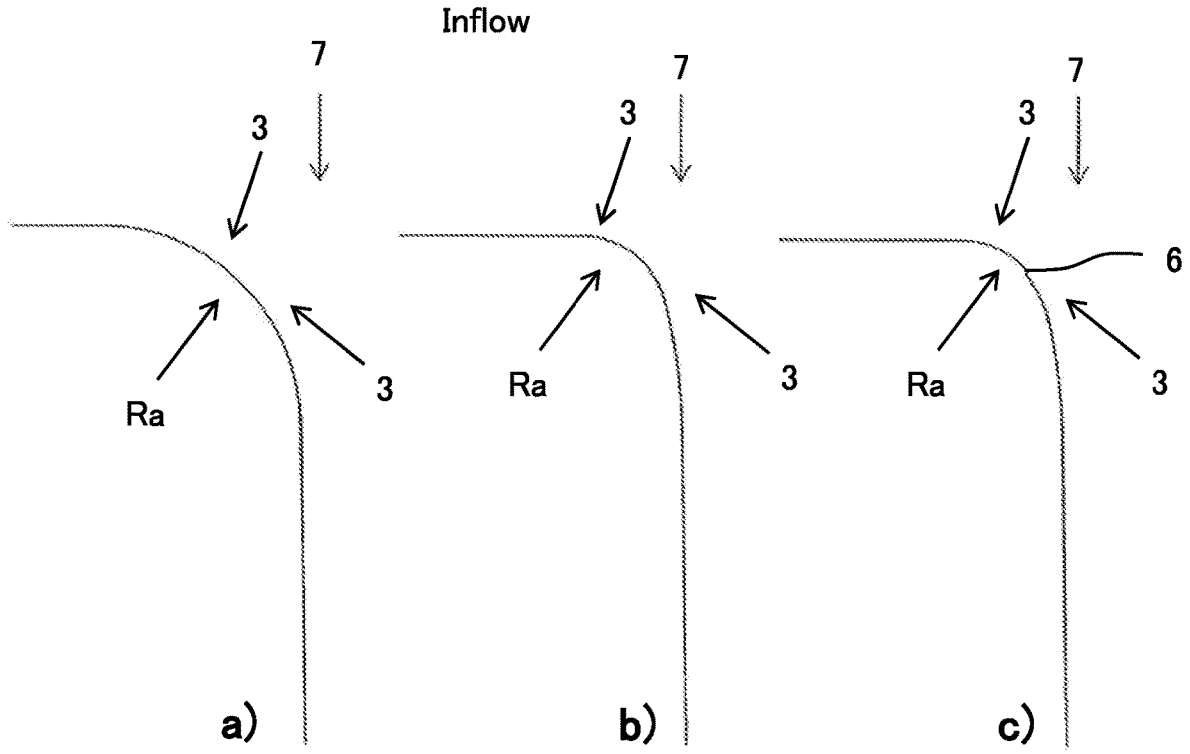

There are different possibilities for embodying and developing the teaching of the present invention advantageously. To this end, reference is made on the one hand to the subordinate claims to claim 1 and on the other hand to the following explanation of a preferred exemplary embodiment of the invention on the basis of the drawing. In conjunction with the explanation of the preferred exemplary embodiment of the invention on the basis of the drawing, generally preferred embodiments and developments of the teaching will also be explained. The figures show the following FIG. 1 shows in a schematic view, sectioned, an exemplary embodiment of a conventional inlet nozzle with a radius, FIG. 2 shows in a perspective view a state of the art inlet nozzle according to FIG. 1, FIG. 3 shows in schematic views, partially, the profile of an inventive inlet nozzle (lower illustration) and in detail, enlarged, the inventive measure in the region of the curved surface, i.e. of the radius, FIG. 4 shows in a schematic partial view the inlet section together with the recess, FIG. 5 shows in a detailed view (Detail X) subject matter from FIG. 4 and FIG. 6 shows in schematic views the inlet section of conventional inlet nozzles without the flow influencing measures (a) and b)) and in a schematic view the inventive inlet nozzle with recess or edge in the inlet section (c)).

FIG. 1 shows in a schematic sectional view an exemplary embodiment of a conventional inlet nozzle 1 with a radius Ra. The inlet nozzle 1 comprises a mounting flange 2 and an inlet section 3 with curved surface 5, wherein the radius Ra has a very special effect on the inflowing air 4.

Figure 2:
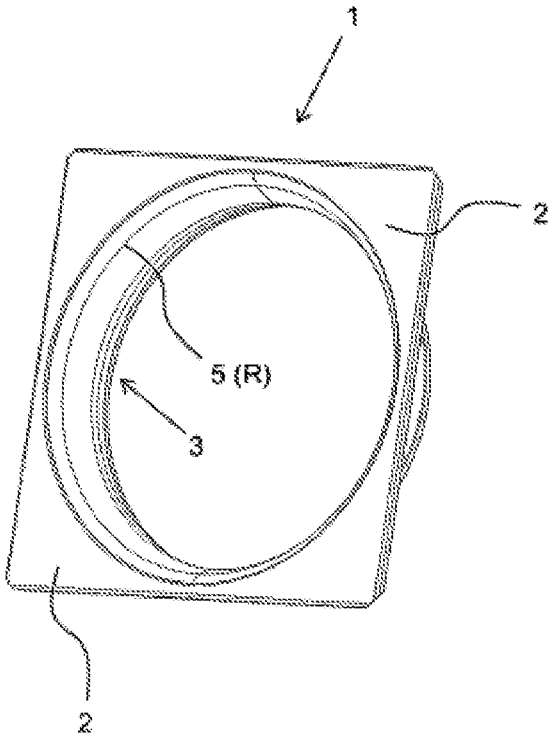

FIG. 2 shows in perspective view an inlet nozzle 1 known from the prior art with a radius Ra, wherein the inlet section 3 with curved surface 5 as well as the mounting flange 2 can be observed there.

Figure 3:
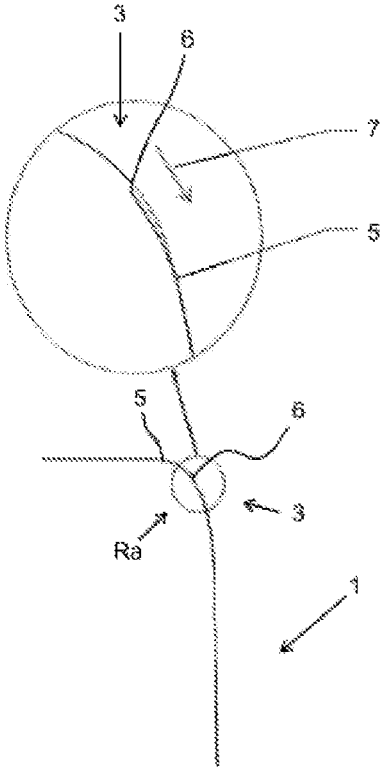

FIG. 3 shows in a lower representation, partially, the profile of the inventive inlet nozzle 1 in the region of the radius Ra, i.e. the inlet section 3 with the curved surface 5 on the inside of the inlet nozzle 1. It can be seen that a measure influencing the flow is provided there, namely a recess 6, which is configured as a recoiling, circumferential edge.

The detailed view arranged above shows the inlet section 3 and the recess 6, whose depth is less than the length or width in the direction of flow 7 of the inflowing air.

With respect to the inflowing air, the recess 6 can cause turbulent boundary layers in the flow, which counteract the problematic stall and hence a noise generation and a loss of power.

FIG. 4 shows in enlarged representation the inlet section 3 of an inventive inlet nozzle with dimensioning, with the following legend:

R=Nozzle inside radius
r=Beginning of the flow element
R'=Beginning of the inlet radius
R"=Distance which the nozzle can be shortened without loss of power
t=Thickness
t'=Depth of the flow element
L=Length of the flow element
φ=Draft angle angle
A=Axis of rotation
broadly
$R<r<R'<R''$
$t>t'$
$L>t'$
Generally "from/to"
$R*1.01\leq r\leq R*1.49$
$R*1.01\leq R'\leq R*1.50$
$R*1.02\leq R''\leq R*1.51$
$t*0.01\leq t'\leq t*0.95$
$t*0.50\leq L\leq t*25.00$
$-90°\leq \sphericalangle \varphi\leq +45°$
As well as preferably "from/to"
$R*1.02\leq r\leq R*1.10$
$R*1.07\leq R'\leq R*1.15$
$R*1.10\leq R''\leq R*1.18$
$t*0.1\leq t'\leq t*0.4$
$t*1.00\leq L\leq t*10.00$
$1°\leq \sphericalangle \varphi\leq 10°$ in relation to the axis of rotation A of the fan propeller.

The preceding dimensions/limits and ratios are to be understood as advantageous characteristics of the inventive teaching.

FIG. 5 shows the highlighted detail X in FIG. 4 with corresponding label, from which the dimensions/limits arise. The angles α, β are shown further enlarged, making it possible to discern that the expansion is implemented as a recoiling edge (6) with bend angles $180°<\alpha<270°$ and $180°>\beta>90°$.

Finally, FIG. 6 shows in comparison the profile of two conventional inlet nozzles 1 in the region of the inlet section 3 with differing radii Ra, wherein the inflow is characterized by an arrow 7, symbolizing the air flowing, wherein variant b) is implemented with a smaller radius and as a result leads to power losses and increased sound levels. Variant c) shows the inventive inlet nozzle 1 with the previously discussed recess 6 in the region of the curved surface 5, as a result of which the inventive effect is generated, and this in the case of the simplest design and manufacture.

Regarding further advantageous embodiments of the inventive teaching, to avoid repetitions reference is made to the general part of the description as well as to the attached claims.

Finally, it should be expressly noted that the previously described exemplary embodiment of the inventive teaching only serves the purpose of explanation of the claimed teaching, but that this teaching is not restricted to the exemplary embodiment.

REFERENCE LIST

1 Inlet nozzle
2 Mounting flange
3 Inlet section
4 Arrow, direction of air flow
5 curved surface
6 Recess, edge
7 Direction of flow, Inflow R Radius (Nozzle inside radius)
Ra Radius

The invention claimed is:

1. An inlet nozzle for a radial, diagonal or axial-flow fan, comprising an inlet section that is circular in cross-section, has a radius of curvature, and tapers in diameter in the direction of flow, characterized by a measure or a flow element on or in the curved surface of the inlet section, in particular for the purpose of forcing turbulent boundary layers in the flow, which can counteract a stall in this region, wherein by a measure or the flow element is designed as a recoiling edge with bend angles $180° < \alpha < 270°$ and $180° > \beta > 90°$, wherein the recoiling edge is formed by the bend angle $\alpha$ and the bend angle $\beta$, where bend angle $\alpha$ is a superposing angle and bend angle $\beta$ is an obtuse angle downstream from the bend angle $\alpha$ in the direction of flow, wherein a length of the recoiling edge is greater than a depth of the recoiling edge.

2. The inlet nozzle according to claim 1, characterized in that the curved inlet section has an annular recess in terms of a zonal expansion of this region.

3. The inlet nozzle according to claim 1, characterized in that two or more recesses spaced at a distance from one another are provided.

4. The inlet nozzle according to claim 2, characterized in that the annular recess is configured approximately centrally or in the inner third of the inlet section.

5. The inlet nozzle according to claim 1, characterized in that the inlet nozzle is made of metal or made of plastic.

6. The inlet nozzle according to claim 2, wherein the inlet nozzle is made of sheet metal, characterized in that the annular recess is greater than the thickness of the sheet metal.

7. A radial, diagonal or axial-flow fan, with a rotary driven impeller for generation of an air flow and an inlet nozzle on the inlet side according to claim 1.

8. The inlet nozzle according to claim 1, characterized in that the inlet nozzle is made of sheet metal.

9. The inlet nozzle according to claim 2, wherein the inlet nozzle is made of sheet metal, characterized in that the annular recess is greater than the thickness of the sheet metal or the length of the annular recess is greater than the depth of the annular recess.

* * * * *